US012577801B2

(12) United States Patent
Thompson

(10) Patent No.: US 12,577,801 B2
(45) Date of Patent: Mar. 17, 2026

(54) RETRACTABLE AWNING WITH ADJUSTABLE PITCH

(71) Applicant: Airxcel, Inc., Wichita, KS (US)

(72) Inventor: Scott Thompson, Aspen, CO (US)

(73) Assignee: Airxcel, Inc., Wichita, KS (US)

( * ) Notice: Subject to any disclaimer, the term of this patent is extended or adjusted under 35 U.S.C. 154(b) by 217 days.

(21) Appl. No.: 18/500,583

(22) Filed: Nov. 2, 2023

(65) Prior Publication Data

US 2024/0191537 A1 Jun. 13, 2024

Related U.S. Application Data

(60) Provisional application No. 63/430,865, filed on Dec. 7, 2022.

(51) Int. Cl.
*E04H 15/08* (2006.01)
*E04F 10/06* (2006.01)
*E04H 15/58* (2006.01)

(52) U.S. Cl.
CPC ..... *E04H 15/08* (2013.01); *E04F 10/06* (2013.01); *E04F 10/0603* (2013.01); *E04F 10/0611* (2013.01); *E04F 10/0614* (2013.01); *E04F 10/0625* (2013.01); *E04F 10/0637* (2013.01); *E04F 10/064* (2013.01); *E04H 15/58* (2013.01)

(58) Field of Classification Search
CPC ..... E04H 15/08; E04F 10/06; E04F 10/0603; E04F 10/0611; E04F 10/0614; E04F 10/0625; E04F 10/0637; E04F 10/064
USPC ..... 135/88.12
See application file for complete search history.

(56) References Cited

U.S. PATENT DOCUMENTS 2,849,249 A * 8/1958 Fridolph ..... F16B 7/1454 403/376
3,589,757 A * 6/1971 Mooney ..... F16M 11/32 248/188.5
4,185,936 A * 1/1980 Takahashi ..... F16B 7/1454 248/188.5
4,596,484 A * 6/1986 Nakatani ..... F16M 11/28 403/109.5
4,761,092 A * 8/1988 Nakatani ..... F16M 11/2021 403/109.5
4,932,622 A * 6/1990 Hayakawa ..... F16M 11/32 248/188.5
6,347,777 B1 * 2/2002 Webber ..... A47C 7/402 248/188.5
6,598,841 B2 * 7/2003 Erickson ..... A47B 9/08 248/407
6,832,784 B1 * 12/2004 Chen ..... A47L 9/244 285/320
7,097,380 B2 * 8/2006 Lee ..... F16B 7/105 15/80

(Continued)

*Primary Examiner* — Robert Canfield
(74) *Attorney, Agent, or Firm* — Hovey Williams LLP

(57) ABSTRACT

A retractable awning is provided with a canopy that is windable around a roller supported at its opposite ends by support arm assemblies that include an adjustable pitch arm linkage that is extendable in length to move the roller in a direction away from a ground surface and retractable in length to move the roller in a direction toward a ground surface. A lever that controls the locking of the adjustable pitch arm linkage at the desired length may be automatically locked during retraction of the adjustable awning from the deployed configuration to a folded storage configuration.

20 Claims, 10 Drawing Sheets

(56) References Cited

U.S. PATENT DOCUMENTS 7,293,934 B1 * 11/2007 Huang ..... F16B 7/105 403/379.5
7,980,519 B2 * 7/2011 Chen ..... A47B 9/14 248/161
8,376,646 B2 * 2/2013 Melino, Sr. ..... F16B 7/1454 403/322.4
8,746,267 B2 * 6/2014 Lovley ..... F16B 7/1454 135/120.2
8,776,810 B2 * 7/2014 Lah ..... A45B 9/00 135/65
9,228,359 B2 * 1/2016 Taylor ..... E04F 10/0648
9,695,635 B2 * 7/2017 Taylor ..... E04F 10/0659
9,755,408 B2 * 9/2017 Taylor ..... E04F 10/0648
10,576,917 B2 * 3/2020 Taylor ..... E04F 10/0611
10,626,618 B2 * 4/2020 Thompson ..... E04F 10/0625
11,083,258 B2 * 8/2021 Heim ..... F16B 7/105
11,118,709 B2 * 9/2021 Hsu ..... F16L 37/20
11,698,092 B2 * 7/2023 Buckley ..... F16B 7/1454 403/109.1
11,993,935 B2 * 5/2024 Thompson ..... E04F 10/0685
12,209,410 B2 * 1/2025 Van De Voorde ..... F16B 2/185
12,245,732 B2 * 3/2025 Libman ..... A47L 13/20
12,280,726 B2 * 4/2025 Taylor ..... B60R 16/027
2002/0062851 A1 * 5/2002 Thompson ..... E04F 10/0614 135/88.12
2004/0101351 A1 * 5/2004 Pitcher ..... F16B 7/1454 403/109.5
2006/0062632 A1 * 3/2006 Jang ..... F16B 7/105 403/378
2006/0169311 A1 * 8/2006 Hwang ..... E04H 15/50 135/142
2007/0012346 A1 * 1/2007 Choi ..... F16B 7/105 135/120.3
2013/0333736 A1 * 12/2013 Albrecht ..... E04F 10/0648 135/88.12
2014/0137381 A1 * 5/2014 Worthman ..... E04F 10/0625 29/401.1
2014/0182074 A1 * 7/2014 Mark ..... A46B 5/0095 15/105
2015/0330086 A1 * 11/2015 Taylor ..... E04H 15/10 160/69
2015/0330087 A1 * 11/2015 Taylor ..... E04H 15/08 160/69
2016/0111862 A1 * 4/2016 Taylor ..... E04H 15/58 174/651
2017/0073975 A1 * 3/2017 Taylor ..... B60R 16/027
2017/0088068 A1 * 3/2017 Taylor ..... B60R 16/027
2017/0138056 A1 * 5/2017 Albertson ..... E04F 10/0681
2018/0291633 A1 * 10/2018 Thompson ..... E04F 10/0625
2019/0277035 A1 * 9/2019 Smoot ..... E04F 10/0614
2020/0317145 A1 * 10/2020 Taylor ..... E04F 10/0614
2021/0189733 A1 * 6/2021 Meyers ..... E06B 9/70
2021/0404187 A1 * 12/2021 Thompson ..... E04F 10/0614
2022/0003000 A1 * 1/2022 Thompson ..... E04F 10/0625
2022/0032443 A1 * 2/2022 Resh ..... B25G 1/04
2022/0127855 A1 * 4/2022 Chen ..... E04F 10/0651

* cited by examiner

RETRACTABLE AWNING WITH ADJUSTABLE PITCH

RELATED APPLICATIONS

The present U.S. non-provisional patent application claims priority benefit of an earlier-filed U.S. provisional patent application of the same title, Ser. No. 63/430,865, filed Dec. 7, 2022, the content of which is hereby incorporated by reference into the present application.

BACKGROUND

The present disclosure relates generally to retractable awnings and, more particularly, to a retractable vertical arm awning of the type for mounting to a side of a recreational vehicle or other vertical support surface.

Retractable awnings are frequently installed on upright support surfaces, such as the side of motor homes, travel trailers, folding camping trailers, truck campers, and other types of recreational vehicles, to provide shelter from sun and rain. The retractable awnings typically include a tubular roller that is supported at its opposite ends by support arm assemblies that are operable to allow the roller to be moved between a position against the side of the recreational vehicle when the awning is in a retracted storage configuration and a position spaced from the recreational vehicle when the awning is in a deployed configuration. A canopy is normally attached at an inner end to the recreational vehicle and is attached at its opposite outer end to the roller. The canopy is wound around the roller when the awning is in the retracted storage configuration and unwinds from the roller as the roller rotates in one direction and moves toward the position spaced from the recreational vehicle. When the roller rotates in an opposite direction, the canopy winds around the roller and causes the roller to move back toward the recreational vehicle. Rotation of the roller may be done manually or by using a motor that drives rotation of an end of the roller.

One type of support arm assembly that is used to support the roller and canopy uses interconnected and articulating linkages that are positioned in a common vertical plane and are each supported by a support bracket on the side of the recreational vehicle. The linkages are constructed so that they are able to fold generally flat against the support bracket when the awning is in the retracted storage configuration. When the awning is moved toward the deployed configuration, the linkages unfold in a manner to position and support the roller at a predetermined elevation above the ground surface. A gas strut may be used to exert a biasing force urging the linkages toward the unfolded configuration. The interconnected linkages may also include a linkage that has an adjustable length that allows a user to vary the slope or pitch of the awning in the deployed configuration by manually adjusting the length of the linkage.

BRIEF DESCRIPTION

This brief description is provided to introduce a selection of concepts in a simplified form that are further described in the detailed description below. This brief description is not intended to identify key features or essential features of the claimed subject matter, nor is it intended to be used to limit the scope of the claimed subject matter. Other aspects and advantages of the present disclosure will be apparent from the following detailed description of the embodiments and the accompanying figures.

In one aspect, the disclosure is directed to a retractable awning for mounting on an upright support surface and comprising: a roller having a first end and an opposite second end; a first support arm assembly for supporting the first end of the roller; a second support arm assembly for supporting the second end of the roller, the first support arm assembly and the second support arm assembly each comprising an adjustable pitch arm linkage that is extendable in length to move the roller away from a ground surface and retractable in length to move the roller toward the ground surface; a canopy having a back end for attachment with the upright support surface and a front end attached to the roller, the roller being rotatable in one direction to cause said canopy to wind around the roller and being rotatable in an opposite direction to allow said canopy to unwind from the roller; and a lever associated with the adjustable pitch arm linkage that is movable between a locking position resisting extension and retraction in length of the adjustable pitch arm linkage and a released position allowing extension and retraction in length of the adjustable pitch arm linkage.

In another aspect, the disclosure is directed to a retractable awning for mounting on an upright support surface and comprising: a roller having a first end and an opposite second end; a first support arm assembly for supporting the first end of the roller; a second support arm assembly for supporting the second end of the roller. The first support arm assembly and the second support arm assembly each comprising: a front channel support arm; a back channel; a top mounting arm having opposite ends connected to the front channel support arm and the back channel by pivot pins; an adjustable pitch arm linkage having opposite ends connected to the front channel support arm and the back channel by pivot pins, the adjustable pitch arm linkage being extendable in length to move the roller away from a ground surface and retractable in length to move the roller toward the ground surface, wherein the first and second support arm assemblies are each constructed to allow the front channel support arm to fold against the back channel and unfold away from the back channel. The retractable awning further comprises: a canopy having a back end for attachment with the upright support surface and a front end attached to the roller, the roller being rotatable in one direction to cause said canopy to wind around the roller and being rotatable in an opposite direction to allow said canopy to unwind from the roller; a gas strut having opposite ends connected to the top mounting arm and the back channel by pivot pins and operable to exert a biasing force against the top mounting arm to assist in unfolding the front channel support arm away from the back channel; and a lever associated with the adjustable pitch arm linkage that is movable between a locking position resisting extension and retraction in length of the adjustable pitch arm linkage and a released position allowing extension and retraction in length of the adjustable pitch arm linkage, wherein the lever is operable to be moved from the released position to the locking position by the folding of the front channel support arm against the back channel.

BRIEF DESCRIPTION OF THE DRAWINGS

The present technology is described in detail below with reference to the attached drawing figures, in which like numerals represent the same components, and wherein.

DETAILED DESCRIPTION

Turning now to the drawings in greater detail and initially to FIGS. 1-6 and 12, a retractable awning having an adjustable pitch is shown and is represented generally by the numeral 10. The retractable awning 10 is shown installed on an upright support surface 12 for use in providing shelter, such as from sun and rain. In some embodiments, the upright support surface 12 may be the side of a motor home, travel trailer, folding camping trailer, truck camper, or other types of recreational vehicle. In another embodiment, the upright support surface 12 may be an exterior wall of a building adjacent a patio or deck. The term "upright" is not intended to be limited to precisely vertical orientations and may encompass orientations that deviate from vertical by up to 10 degrees in some embodiments and by up to 20 degrees in other embodiments.

Figure 1:
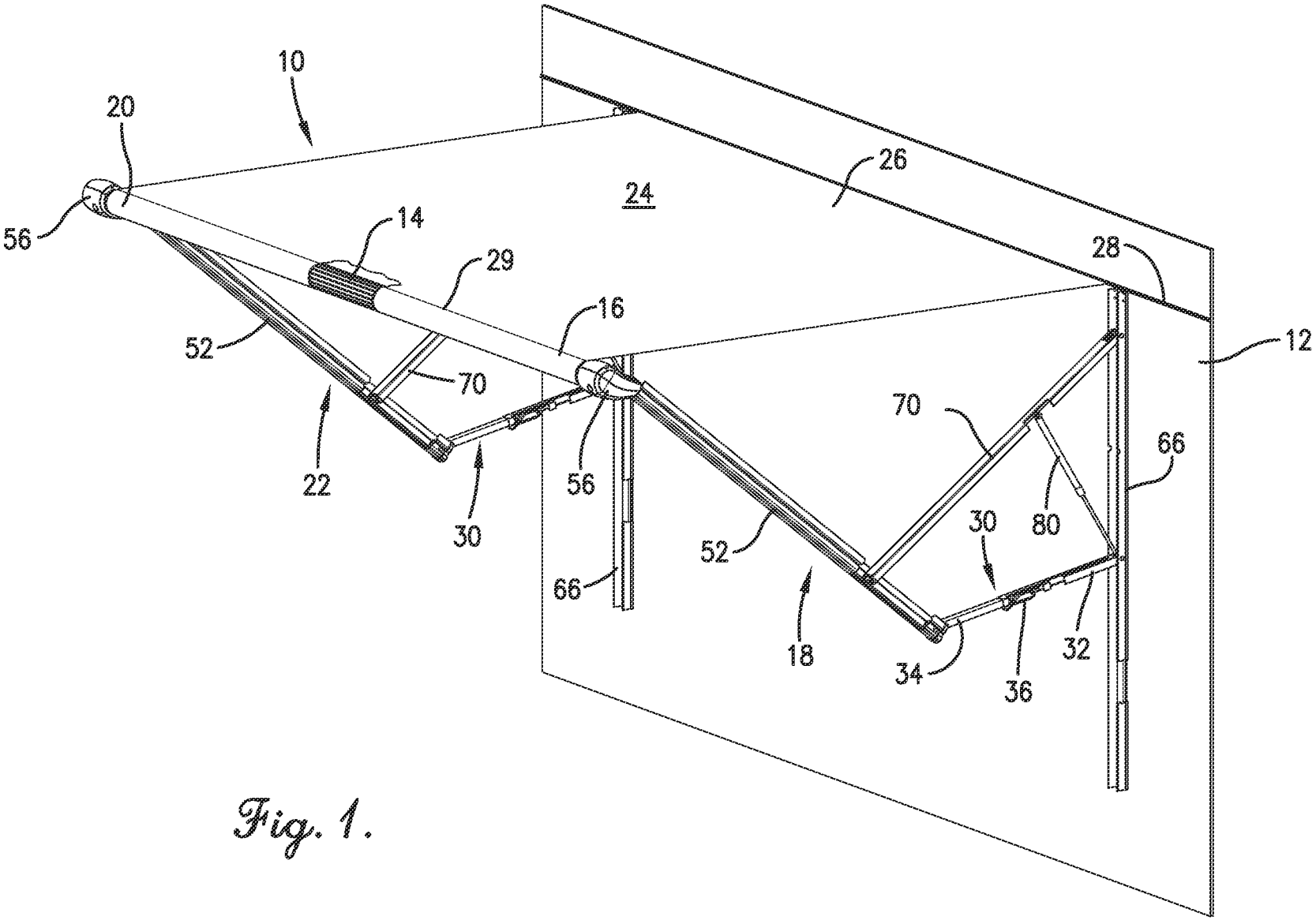
FIG. 1 is a front perspective view of a retractable awning having an adjustable pitch according to aspects of the disclosure and shown mounted on an upright support surface, such as a side of a recreational vehicle, and positioned in a first, fully deployed, configuration.

The retractable awning 10 comprises an elongated roller 14 that may of a tubular construction and has a first end 16 that is supported by a first support arm assembly 18 and an opposite second end 20 that is supported by a second support arm assembly 22. The first and second support arm assemblies 18 and 22 are mounted on the upright support surface 12 and may be of generally the same construction except as otherwise described herein. The retractable awning 10 further includes a canopy 24 having a back end 26 attached with the upright support surface 12, such as by an awning rail 28, and a front end 29 that is attached to the roller 14. The canopy 24 may be made from vinyl or acrylic fabrics or other materials and is able to wind on the roller 14 when the roller 14 rotates in one direction and unwind from the roller 14 when the roller 14 rotates in an opposite direction during movement of the retractable awning 10 between a deployed configuration as shown in FIG. 1 and a folded and retracted storage configuration as shown in FIG. 12.

The first support arm assembly 18 and the second support arm assembly 22 each lie in a generally vertical plane and comprise interconnected linkages constructed in a manner to allow them to fold against the upright support surface 12 when the retractable awning 10 is in the retracted storage configuration and then upfold and extend outwardly from the upright support surface 12 to position the retractable awning in a deployed configuration.

Figure 2:
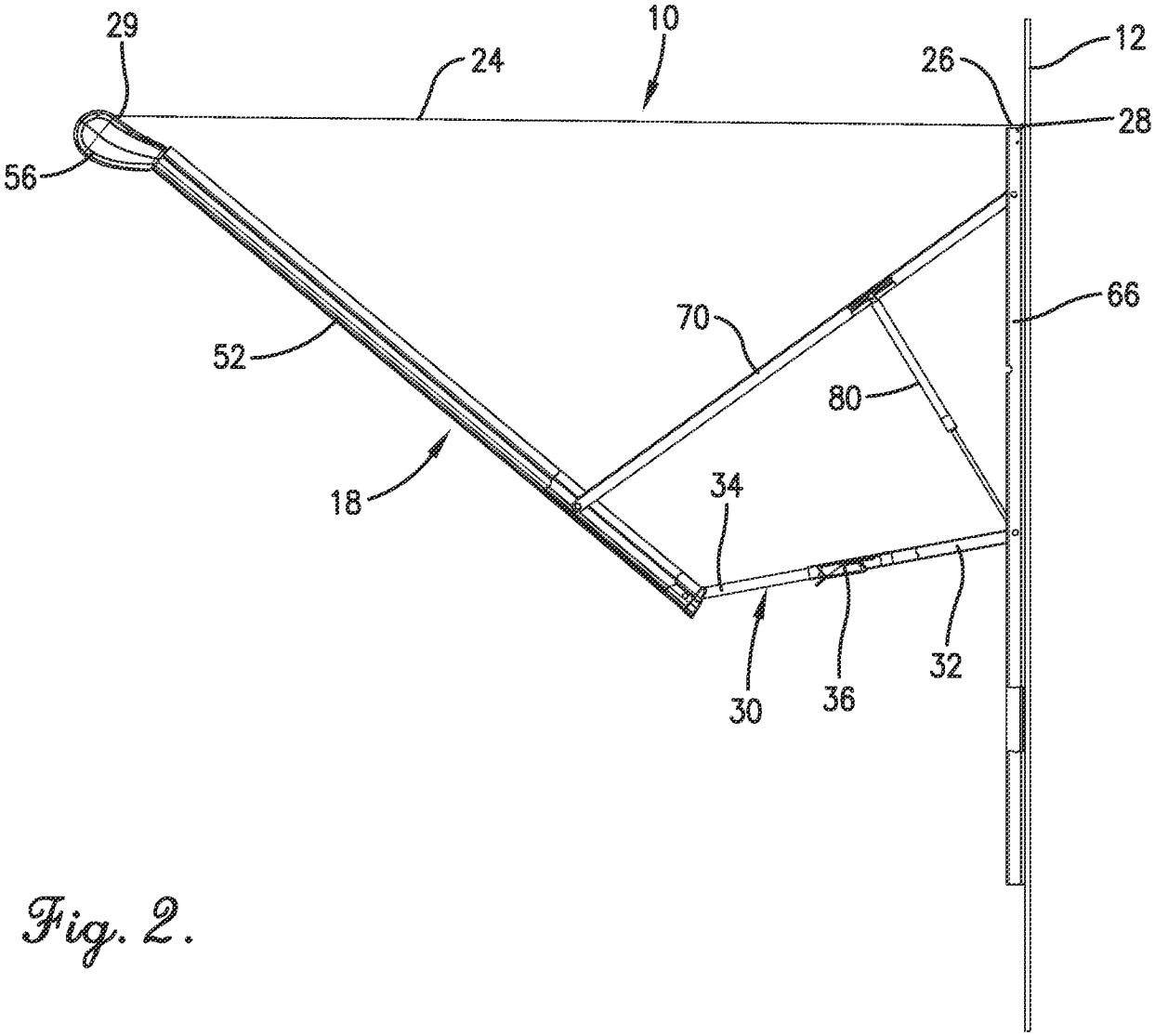
FIG. 2 is a side elevation view of the retractable awning in the fully deployed configuration.
Figure 3:
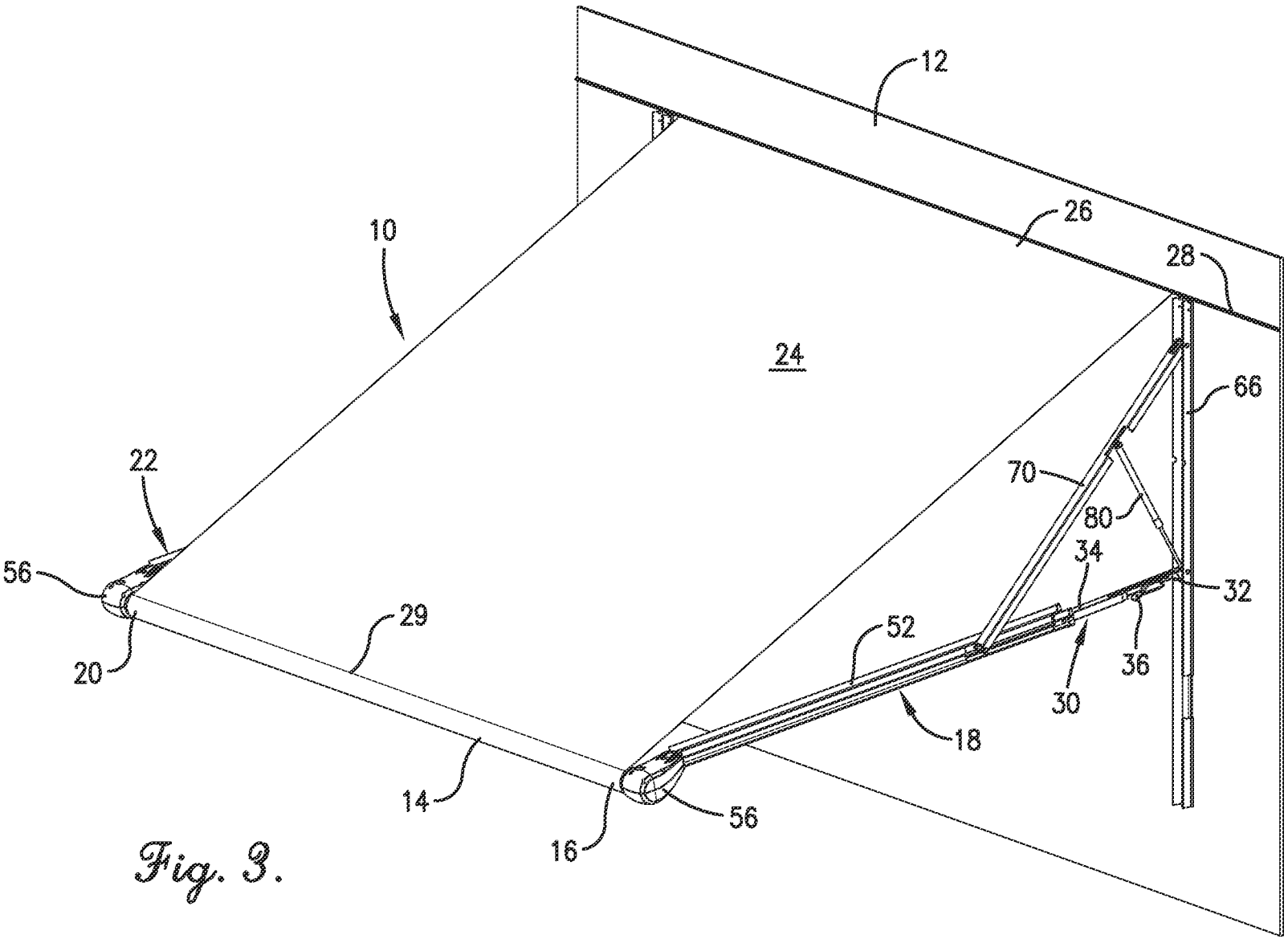
FIG. 3 is a front perspective view of the retractable awning in a second, partially deployed, configuration with a different slope or pitch from the view shown in FIG. 1.
Figure 4:
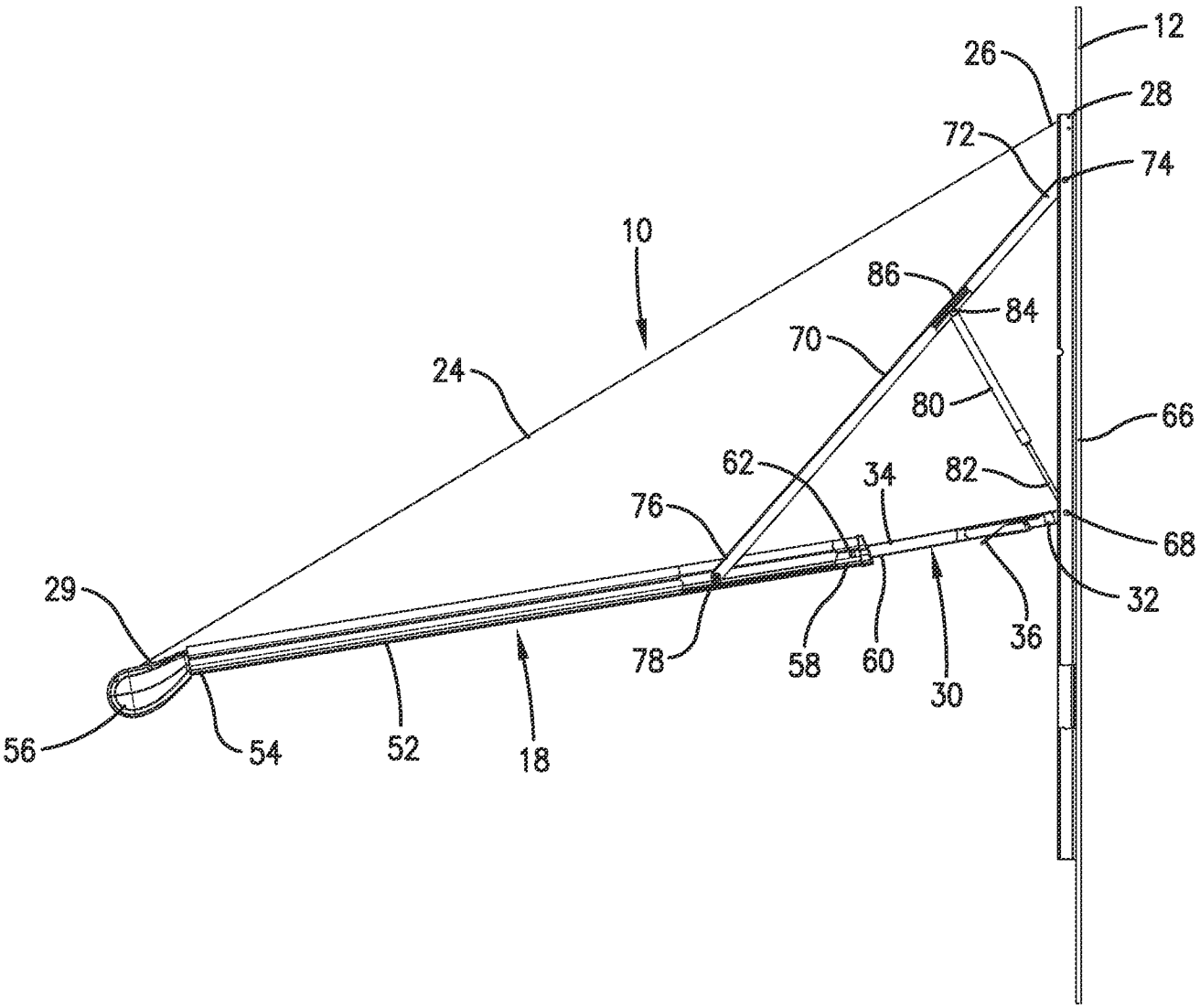
FIG. 4 is a side elevation view of the retractable awning in the partially deployed configuration shown in FIG. 3.

Each of the first and second support arm assemblies 18 and 22 includes an adjustable pitch arm linkage 30 that the allows the slope or pitch of the canopy 24 to be adjusted by the user. For example, the adjustable pitch arm linkage 30, when extended in length, may allow the retractable awning 10 to be initially opened to a first, fully deployed, configuration, such as shown in FIGS. 1 and 2 where the canopy 24 is in a generally horizontal orientation. Retraction of the length of the adjustable pitch arm linkage 30 then allows the retractable awning 10 to be moved to a second configuration such as shown in FIGS. 3 and 4 where the canopy 24 slopes downwardly from the vertical support surface 12, such as at an angle approximately 30 degrees from the horizontal. By varying the amount of extension of the length of the adjustable pitch arm linkage 30, the canopy 24 can be placed at other pitches. These changes in pitch result from the adjustable pitch arm linkage 30 causing the roller 14 to be positioned closer to or further away from a ground surface.

The adjustable pitch arm linkage 30 may comprise an inner channel 34 that is longitudinally moveable within and extending from an outer channel 32 in a telescoping fashion to allow the extension and retraction in length of the adjustable pitch arm linkage 30. In one embodiment, the inner channel 34 has an inverted U-configuration and the outer channel 32 has a similar configuration except inwardly facing flanges are positioned at the otherwise open bottom surface of the outer channel 32 to retain the inner channel 34 within the outer channel 32.

Figure 5:
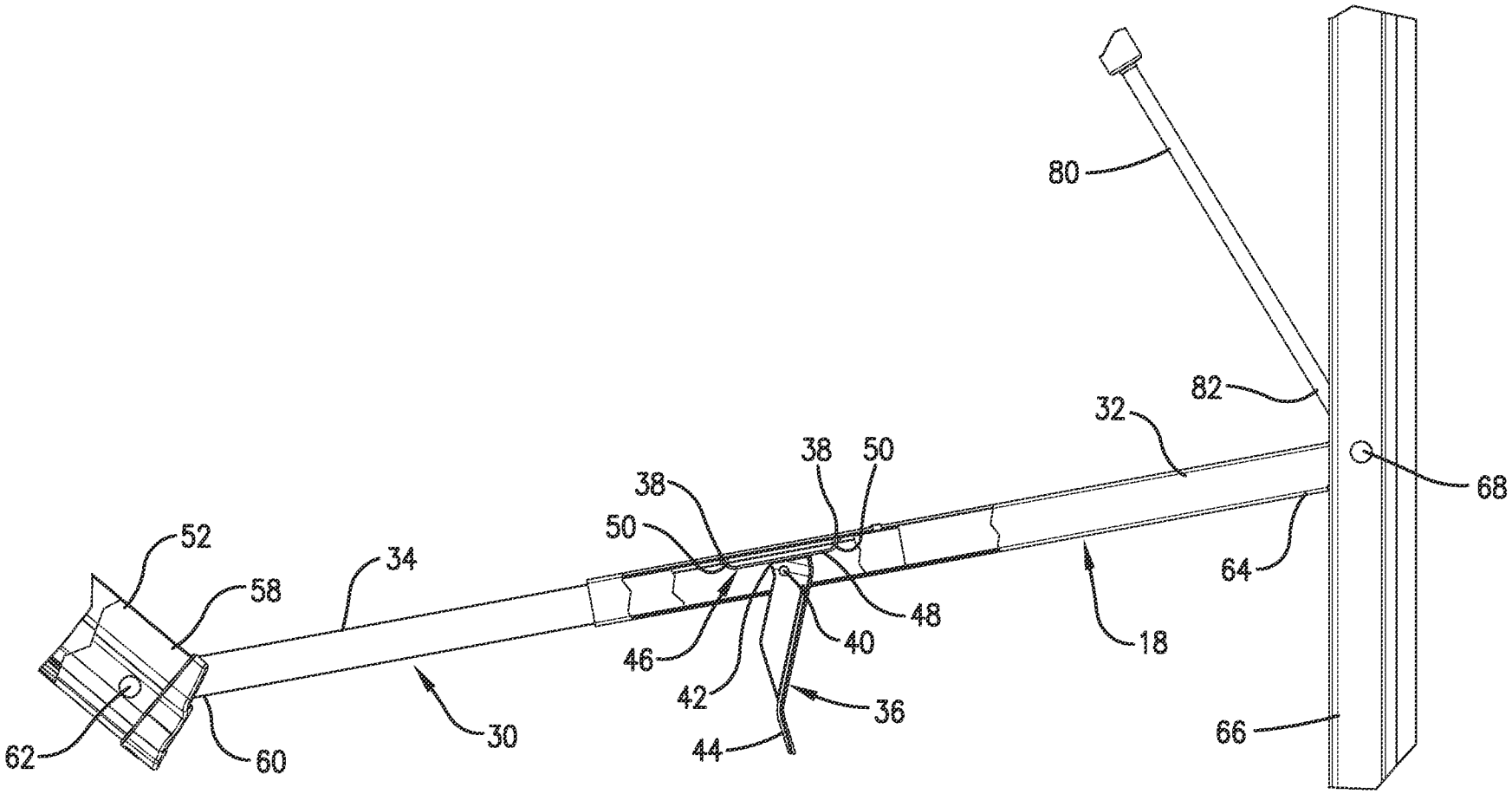
FIG. 5 is a fragmentary side elevation view of a support arm assembly of the retractable awning, with a portion of an adjustable pitch arm linkage shown fully extended and with portions broken away to show internal details.
Figure 6:
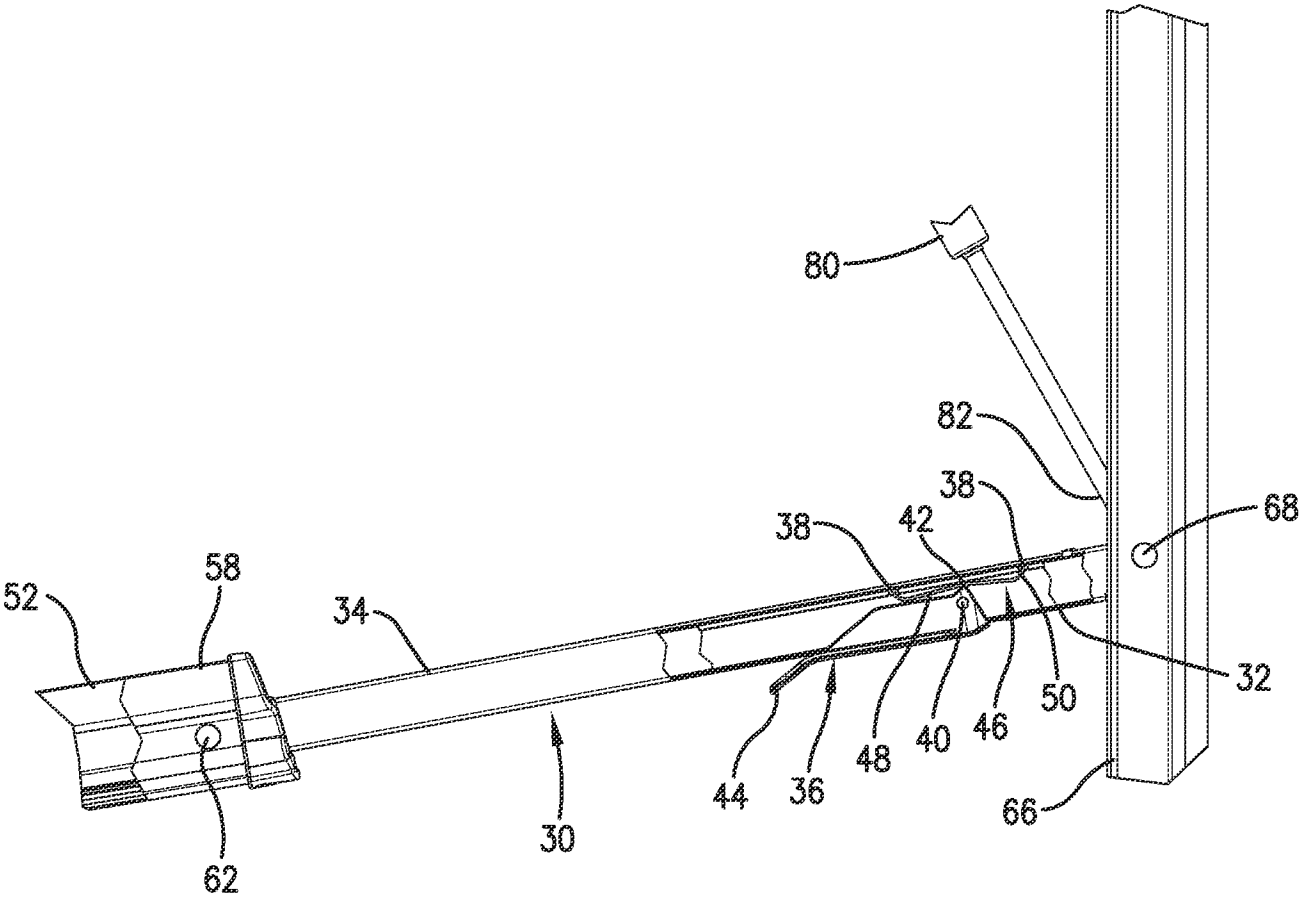
FIG. 6 is a fragmentary side elevation view of the support arm assembly and similar to the view shown in FIG. 3, but with the adjustable pitch arm linkage shown fully retracted.

The first and second support arm assemblies 18 and 22 each include a lever 36 associated with the adjustable pitch arm linkage 30 that is movable between a locking position, such as shown in FIG. 6, that resists extension and retraction in length of the adjustable pitch arm linkage 30 and a released position, such as shown in FIG. 5, that allows extension and retraction in length of the adjustable pitch arm linkage 30. The lever 36 is operably coupled with a braking surface 38 that is moveable to exert a braking force to resist longitudinal movement of the inner channel 34 within the outer channel 32 when the lever 36 is moved to its locking position. The braking force is then released or reduced when the lever 36 is moved to its released position.

The lever 36 may be mounted within the inner channel 34, such as by a pivot pin 40 that extends through sidewalls of the inner channel 34 and a cam portion 42 of the lever 36. A handle portion 44 of the lever extends from the cam portion 42 outward through an open bottom of the inner channel 34 and is sufficient size and length to be readily grasped and manipulated by a user. In one embodiment, a flat spring 46 may be positioned within the inner channel 34 in engagement with an outer surface of the cam portion 42 of the lever 36.

The flat spring 46 is positioned so that it is able to flex in response to the camming action of the cam portion 42 during rotation of the lever 36. When the cam portion 42 is moved to an over center position on the flat spring 46, the flexed flat spring 46 exerts a force on the cam portion 42 that moves the lever 36 toward its locking position with a snapping action and then resists removal of the lever 36 from the locking position. The user must then exert sufficient force on the handle portion 44 to overcome the spring force when moving the lever 36 from the locking position to the released position. The cam portion 42 may include a generally planar portion that rests against flat spring 46 when the lever 36 is in the released position to maintain the handle portion 44 in a stable and readily accessible orientation.

In one arrangement, as best seen in FIGS. 5 and 6, the flat spring 46 has a main body 48 positioned within the inner channel 34 and at least one end portion 50 that extends through an opening in the inner channel 34. The end portion 50 has a terminus that is in engagement with the outer channel 32 and defines the braking surface 38. When the lever 36 is in the locking position, as shown in FIG. 3, the outer surface of the cam portion 42 exerts a force on the flat spring 46 that causes flexing of the flat spring 46 and is translated to the braking force exerted by the braking surface 38 on the outer channel 32 to resist longitudinal movement of the inner channel 34 within the outer channel 32.

Figure 8:
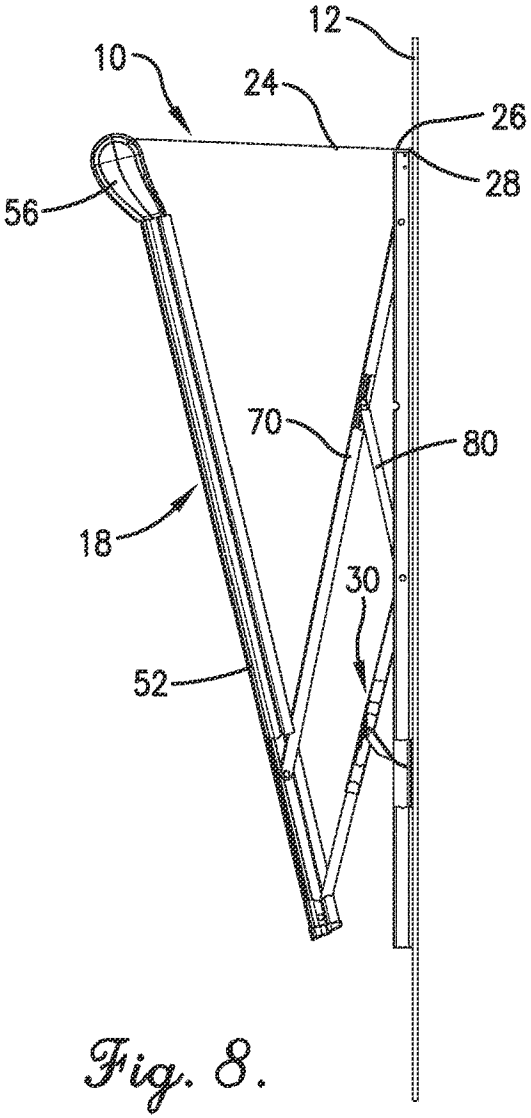
FIG. 8 is a side elevation view of the retractable awning in the third configuration shown in FIG. 7.
Figure 7:
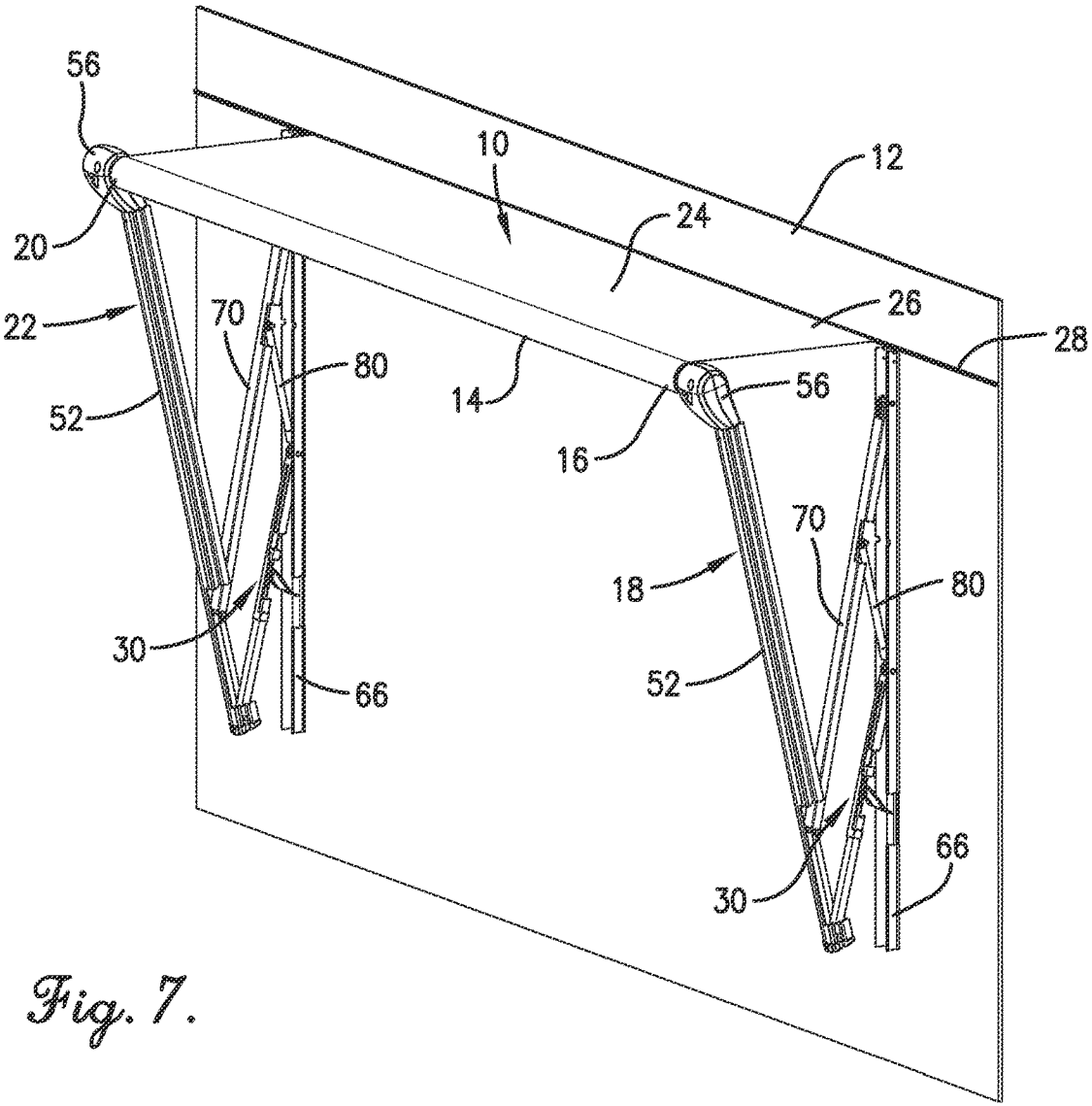
FIG. 7 is a front perspective view of the retractable awning in a third, partial deployed, configuration.
Figure 9:
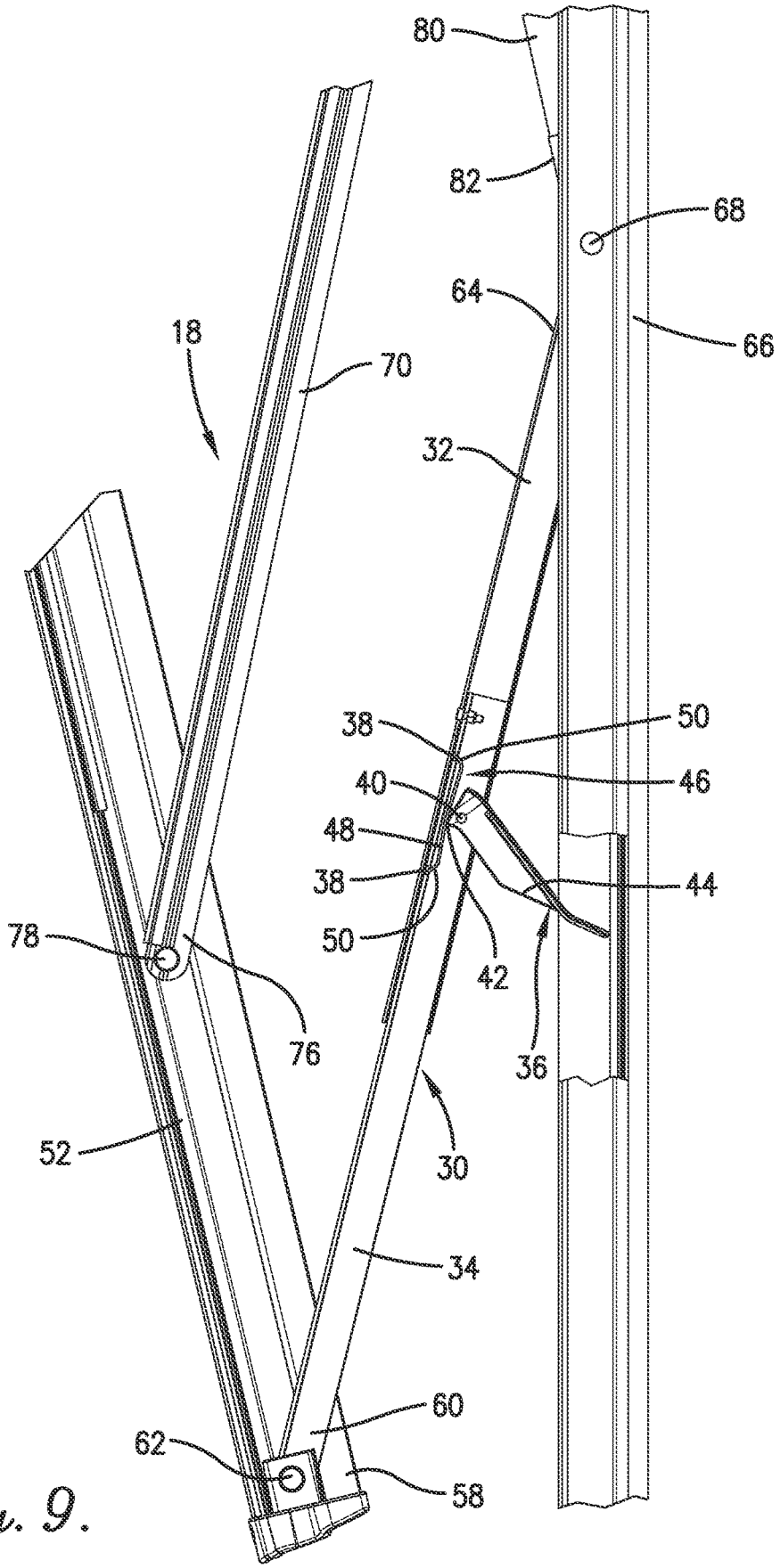
FIG. 9 is a fragmentary enlarged view of the support arm assembly in the third configuration shown in FIGS. 7 and 8.
Figure 10:
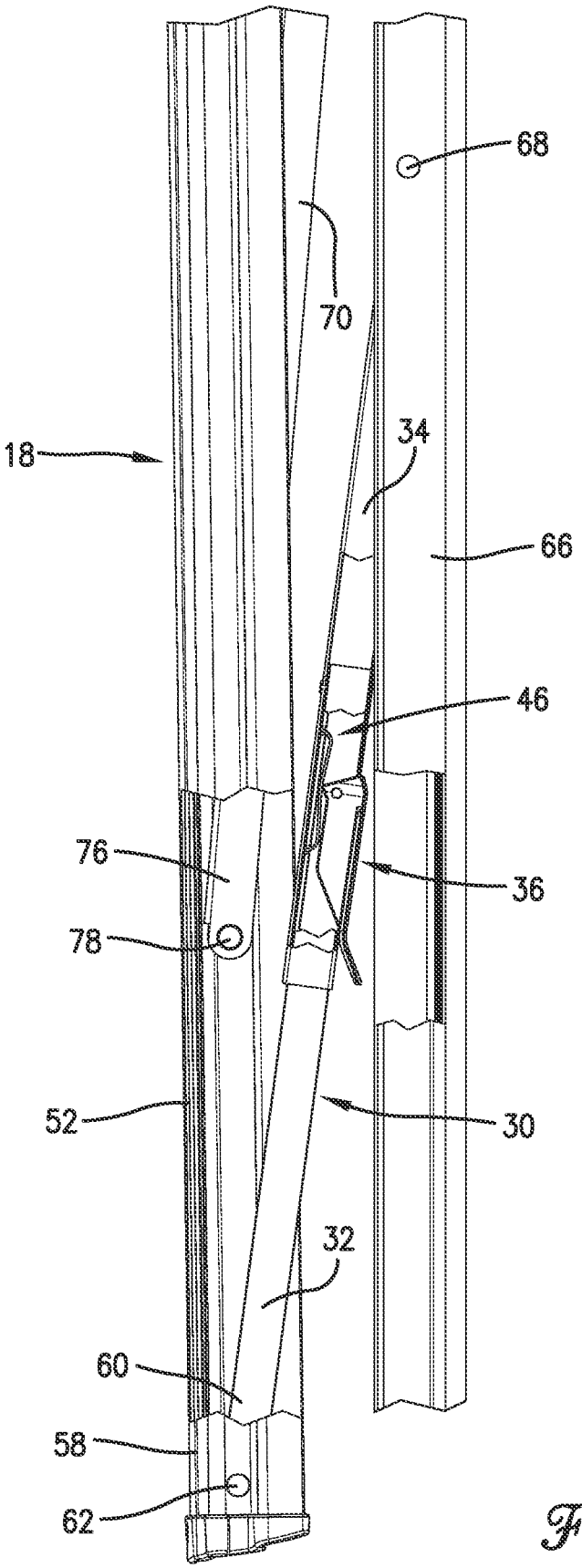
FIG. 10 is a fragmentary view of the support arm assembly similar to the view shown in FIG. 9, but with the support arm assembly shown in a further retracted position and the adjustable pitch arm linkage shown in a locked position.

The lever 36 may also be arranged and operable so that it is automatically moved from the released position to the locking position when the first and second support arm assemblies 18 and 22 are folded toward the retracted storage position. This can be seen in FIGS. 7-9 where a free end of the handle portion 44 of the lever 36 is first brought into contact with a stationary portion of the second support arm assembly 20 and then in FIG. 10 where the lever 36 has snapped shut to the locking position by further folding movement of the second support arm assembly 20.

In one embodiment, in addition to the adjustable pitch arm linkage 30, each of the first and second support arm assemblies 18 and 22 may include a front channel support arm 52 having a front end that is coupled with a head assembly 56. The head assembly 56 in turn is coupled with the first or second end 16 or 20 of the roller 14 to allow the rotation of the roller 14. One of the head assemblies 56 may be a drive head assembly that includes a motor (not shown) for driving rotation of the roller 14. The other head assembly 56 may be an idler head assembly.

A back end 58 of the front channel support arm 52 may be connected to a front end 60 of the adjustable pitch arm linkage 30 by a pivot pin 62. A back end 64 of the adjustable pitch arm linkage 30 may be connected to a middle portion of a vertically extending back channel 66 by a pivot pin 68. The back channel 66 is secured to the upright support surface 12, such as by mounting brackets (not shown). A top mounting arm 70 has a back end 72 connected by a pivot 74 to the back channel 66 at a location spaced above the pivot pin 68 that connects the adjustable pitch arm linkage 30 to the back channel 66. A front end 76 of the top mounting arm 70 is connected by a pivot pin 78 to the front channel support arm 52 at a located spaced forwardly from its back end 58. Collectively, the interconnected adjustable pitch arm linkage 30, front channel support arm 52, back channel 66, and top mounting arm 70 form an articulating linkage that may be folded generally flat when the retractable awning 10 is in the retracted storage configuration and may be extended outwardly to support the roller 14 when the retractable awning 10 is in the deployed configuration.

A gas strut 80 may be used to assist in deployment of the retractable awning 10 by exerting a biasing or lifting force against the top mounting arm 70 to assist in unfolding the front channel support arm 52 from the back channel 66. A lower end 82 of the gas strut 80 may be connected to the back channel 66 using pivot pin 68 and an upper end 84 of the gas strut 70 may be connected to an intermediate portion of the top mounting arm 70 by a pivot pin 86.

Figure 11:
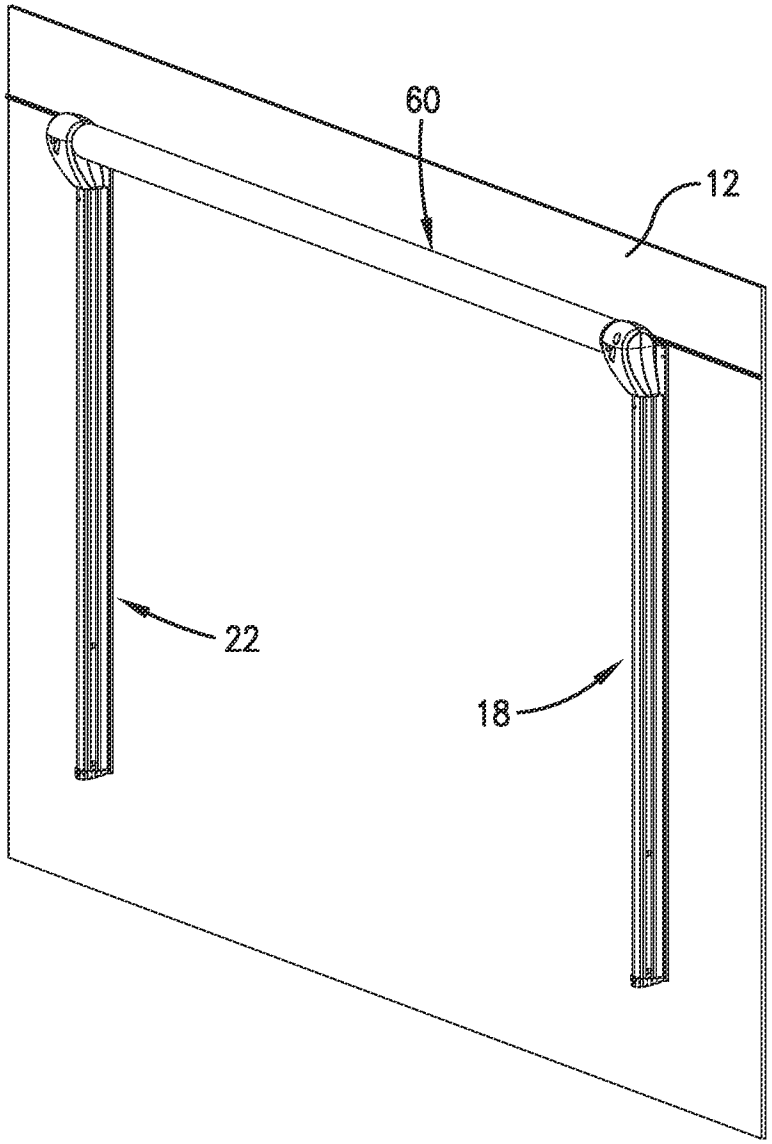
FIG. 11 is a front perspective view of the retractable awning shown in a retracted storage configuration.

In use, the retractable awning 10 is moved from the retracted storage configuration folded against the upright support structure 12 (FIG. 11) to the first, fully deployed configuration (FIG. 1) by the gas strut 80 exerting an upward biasing force against the top mounting arm 70 in the first and second support arm assemblies 18 and 22. In some embodiments, a user may need to supplement force exerted by the gas strut 80 to move the retractable awning into the fully deployed configuration. While the retractable awning 10 is folded in its retracted storage position and is unfolded to its fully deployed configuration, the adjustable pitch arm linkage 30 is locked in its extended length by the positioning of the lever 36 in its locking position. The pitch of the retractable awning 10 on one side may be lowered by the user moving the lever 36 to its released position and then returning the lever 36 to its locking position once the desired pitch is achieved. The pitch of the retractable awning 10 may be lowered on the other side in the same manner.

When the retractable awning 10 is returned to the folded storage configuration from its fully deployed configuration, the levers 36 may remain in their locking positions. If the pitch of the retractable awning 10 has been lowered, the levers 36 should be moved to their released positions to allow the adjustable pitch arm linkage 30 to extend to its extended length during the folding process. The levers 36 are then automatically moved to their locking positions as the folding nears completion and the handle portions 44 of the levers 36 contact the back channel 66 or other portions of the first and second support arm assemblies 18 and 22. If the levers 36 are not first moved to their unlocked positions during closing of the retractable awning 10, the frictional force exerted by the braking surfaces 38 may nonetheless be overcome by the force exerted by the folding of the first and second support arm assemblies 18 and 22 to allow the adjustable pitch arm linkage to extend to its extended length.

From the foregoing, it will be seen that this disclosure is one well adapted to attain all the ends and objects set forth above, together with other advantages which are obvious and inherent to the system and method. It will be understood that certain features and sub-combinations are of utility and may be employed without reference to other features and sub-combinations.

ADDITIONAL CONSIDERATIONS

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the current technology can include a variety of combinations and/or integrations of the embodiments described herein.

In the specification and claims, reference will be made to several terms, which shall be defined to have the following meanings. The singular forms "a," "an," and "the" include plural references unless the context clearly dictates otherwise. "Optional" or "optionally" means that the subsequently described event or circumstance may or may not occur, and that the description includes instances where the event occurs and instances where it does not.

Approximating language, as used herein throughout the specification and the claim, may be applied to modify any quantitative representation that could permissibly vary without resulting in a change in the basic function to which it is related. Accordingly, a value modified by a term or terms, such as "about," "approximately," and "substantially" are not to be limited to the precise value specified. In at least some instances, the approximating language may correspond to the precision of an instrument for measuring the value. Range limitations may be combined and/or interchanged. Such ranges are identified and include all the sub-ranges contained therein unless context or language indicates otherwise.

As used herein, the terms "axial" and "axially" refer to directions and orientations extending substantially parallel to a center longitudinal axis of the combustor. The terms "radial" and "radially" refer to directions and orientations extending substantially perpendicular to the central axis. Moreover, directional references, such as, "top," "bottom," "front," "back," "side," and similar terms are used herein solely for convenience and should be understood only in relation to each other. For example, a component might in practice be oriented such that faces referred to herein as "top" and "bottom" are in practice sideways, angled, inverted, etc. relative to the chosen frame of reference.

The terms "coupled," "fixed," "attached to," and the like refer to both direct coupling, fixing, or attaching, as well as indirect coupling, fixing, or attaching through one or more intermediate components or features, unless otherwise specified herein.

Although the present application sets forth a detailed description of numerous different embodiments, it should be understood that the legal scope of the description is defined by the words of the claims and equivalent language. The detailed description is to be construed as exemplary only and does not describe every possible embodiment because describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order recited or illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein. The foregoing statements in this paragraph shall apply unless so stated in the description and/or except as will be readily apparent to those skilled in the art from the description.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

Although the disclosure has been described with reference to the embodiments illustrated in the attached figures, it is noted that equivalents may be employed, and substitutions made herein, without departing from the scope of the disclosure as recited in the claims.

What is claim is:

1. A retractable awning for mounting on an upright support surface, said awning comprising:

a roller having a first end and an opposite second end;

a first support arm assembly for supporting the first end of the roller;

a second support arm assembly for supporting the second end of the roller, wherein the first and second support arm assemblies are each constructed in a manner to allow them to move between a retracted storage configuration and an outwardly deployed configuration;

wherein the first support arm assembly and the second support arm assembly each comprise an adjustable pitch arm linkage that is extendable in length to move the roller in a direction away from a ground surface and retractable in length to move the roller in a direction toward a ground surface;

a canopy having a back end for attachment with the upright support surface and a front end attached to the roller, the roller being rotatable in one direction to cause said canopy to wind around the roller and being rotatable in an opposite direction to allow said canopy to unwind from the roller; and a lever associated with each adjustable pitch arm linkage that is movable between a locking position resisting extension and retraction in length of the adjustable pitch arm linkage and a released position allowing extension and retraction in length of the adjustable pitch arm linkage, wherein each lever is constructed to be automatically moved from the released position to the locking position as the first and second support arm assemblies are moved to the retracted storage configuration.

2. The retractable awning of claim 1, wherein the adjustable pitch arm linkage comprises an inner channel longitudinally moveable within and extending from an outer channel to allow the extension and retraction in length of the adjustable pitch arm linkage.

3. The retractable awning of claim 2, including a braking surface moveable to exert a braking force by movement of each lever to the locking position to resist longitudinal movement of the inner channel within the outer channel, said braking force being released when the lever is moved to the released position.

4. The retractable awning of claim 1, wherein each adjustable pitch arm linkage comprises an inner channel longitudinally moveable within and extending from an outer channel to allow the extension and retraction in length of the adjustable pitch arm linkage.

5. The retractable awning of claim 4, wherein each lever is mounted within the inner channel and includes a handle portion that extends outwardly through an open bottom of the outer channel.

6. The retractable awning of claim 5, including a braking surface moveable to exert a braking force by movement of each lever to the locking position to resist longitudinal movement of the inner channel within the outer channel, said braking force being released when each lever is moved to the released position.

7. The retractable awning of claim 6, wherein a free end of the handle portion of each lever when in the released position contacts a stationary portion of the associated one of the first and second support arm assemblies when the first and second support assemblies are moved to the retracted storage configuration to cause the automatic movement of the lever from the released position to the locking position.

8. The retractable awning of claim 7, including a flat spring having a main body positioned within the inner channel and an end portion extending through an opening in the inner channel, wherein a terminus of the end portion defines the braking surface.

9. The retractable awning of claim 8, wherein each lever includes a cam that rotatably engages the main body of the flat spring, the cam being movable to an over center position that moves the lever to the locking position and causes the braking surface to exert the braking force.

10. A retractable awning for mounting on an upright support surface, said awning comprising:

a roller having a first end and an opposite second end;

a first support arm assembly for supporting the first end of the roller;

a second support arm assembly for supporting the second end of the roller, wherein the first support arm assembly and the second support arm assembly each comprise an adjustable pitch arm linkage that is extendable in length to move the roller in a direction away from a ground surface and retractable in length to move the roller in a direction toward a ground surface, wherein each adjustable pitch arm linkage comprises an inner channel longitudinally moveable within and extending from an outer channel to allow the extension and retraction in length of the adjustable pitch arm linkage;

a canopy having a back end for attachment with the upright support surface and a front end attached to the roller, the roller being rotatable in one direction to cause said canopy to wind around the roller and being rotatable in an opposite direction to allow said canopy to unwind from the roller;

a lever associated with each adjustable pitch arm linkage that is movable between a locking position resisting extension and retraction in length of the adjustable pitch arm linkage and a released position allowing extension and retraction in length of the adjustable pitch arm linkage;

a braking surface moveable to exert a braking force by movement of each lever to the locking position to resist longitudinal movement of the inner channel within the outer channel, said braking force being released when the lever is moved to the released position; and a flat spring having a main body positioned within the inner channel and an end portion extending through an opening in the inner channel, wherein a terminus of the end portion defines the braking surface.

11. The retractable awning of claim 10, wherein each lever includes a cam that rotatably engages the main body of the flat spring, the cam being movable to an over center position that moves the lever to the locking position and causes the braking surface to exert the braking force.

12. The retractable awning of claim 11, wherein the first and second support arm assemblies each additionally comprise a front channel support arm, a back channel, and a top mounting arm, wherein opposite ends of each adjustable pitch arm linkage are connected to the front channel support arm and the back channel by pivot pins and opposite ends of the top mounting arm are connected to the front channel support arm and the back channel by pivot pins in a manner to allow the front channel support arm to fold against the back channel and unfold away from the back channel.

13. The retractable awning of claim 12, wherein each lever is operable to be moved from the released position to the locking position by folding of the front channel support arm against the back channel.

14. The retractable awning of claim 13, including a gas strut having opposite ends connected to the top mounting arm and the back channel and operable to exert a biasing force against the top mounting arm to assist in unfolding the front channel support arm away from the back channel.

15. A retractable awning for mounting on an upright support surface, said awning comprising:

a roller having a first end and an opposite second end;

a first support arm assembly for supporting the first end of the roller;

a second support arm assembly for supporting the second end of the roller, the first support arm assembly and the second support arm assembly each comprising:

a front channel support arm;

a back channel;

a top mounting arm having opposite ends connected to the front channel support arm and the back channel by pivot pins, wherein the first support arm assembly and the second support arm assembly each comprise an adjustable pitch arm linkage that is extendable in length to move the roller in a direction away from a ground surface and retractable in length to move the roller in a direction toward a ground surface, wherein the first and second support arm assemblies are each constructed to allow the front channel support arm to fold against the back channel and unfold away from the back channel;

a canopy having a back end for attachment with the upright support surface and a front end attached to the roller, the roller being rotatable in one direction to cause said canopy to wind around the roller and being rotatable in an opposite direction to allow said canopy to unwind from the roller;

a gas strut having opposite ends connected to the top mounting arm and the back channel by pivot pins and operable to exert a biasing force against the top mounting arm to assist in unfolding the front channel support arm away from the back channel; and a lever associated with each adjustable pitch arm linkage that is movable between a locking position resisting extension and retraction in length of the adjustable pitch arm linkage and a released position allowing extension and retraction in length of the adjustable pitch arm linkage, wherein each lever is operable to be automatically moved from the released position to the locking position by the folding of the front channel support arm against the back channel.

16. The retractable awning of claim 15, wherein each adjustable pitch arm linkage comprises an inner channel longitudinally moveable within and extending from an outer channel to allow the extension and retraction in length of the adjustable pitch arm linkage.

17. The retractable awning of claim 16, including a braking surface moveable to exert a braking force by movement of each lever to the locking position to resist longitudinal movement of the inner channel within the outer channel, said braking force being released when the lever is moved to the released position.

18. A retractable awning for mounting on an upright support surface, said awning comprising:

a roller having a first end and an opposite second end;

a first support arm assembly for supporting the first end of the roller;

a second support arm assembly for supporting the second end of the roller, the first support arm assembly and the second support arm assembly each comprising:

a front channel support arm;

a back channel;

a top mounting arm having opposite ends connected to the front channel support arm and the back channel by pivot pins;

the first support arm assembly and the second support arm assembly each comprising an adjustable pitch arm linkage that is extendable in length to move the roller in a direction away from a ground surface and retractable in length to move the roller in a direction toward a ground surface, wherein each adjustable pitch arm linkage comprises an inner channel longitudinally moveable within and extending from an outer channel to allow the extension and retraction in length of the adjustable pitch arm linkage, wherein the first and second support arm assemblies are each constructed to allow the front channel support arm to fold against the back channel and unfold away from the back channel;

a canopy having a back end for attachment with the upright support surface and a front end attached to the roller, the roller being rotatable in one direction to cause said canopy to wind around the roller and being rotatable in an opposite direction to allow said canopy to unwind from the roller;

a gas strut having opposite ends connected to the top mounting arm and the back channel by pivot pins and operable to exert a biasing force against the top mounting arm to assist in unfolding the front channel support arm away from the back channel; and a lever associated with each adjustable pitch arm linkage that is movable between a locking position resisting extension and retraction in length of the adjustable pitch arm linkage and a released position allowing extension and retraction in length of the adjustable pitch arm linkage, wherein the lever is operable to be moved from the released position to the locking position by the folding of the front channel support arm against the back channel;

a braking surface moveable to exert a braking force by movement of each lever to the locking position to resist longitudinal movement of the inner channel within the outer channel, said braking force being released when the lever is moved to the released position; and a flat spring having a main body positioned within the inner channel and opposite end portion extending through respective openings in the inner channel, wherein a terminus of the end portion defines the braking surface.

19. The retractable awning of claim 18, wherein each lever includes a cam that rotatably engages the main body of the flat spring, the cam being movable to an over center position that moves the lever to the locking position and causes the braking surface to exert the braking force.

20. The retractable awning of claim 19, each lever is mounted within the inner channel and includes a handle portion that extends outwardly through an open bottom of the outer channel to contact a stationary portion of the associated one of the first and second support arm assemblies when the first and second support assemblies are moved to the retracted storage configuration to cause the lever to be moved from the released position to the locking position.

* * * * *